US006859959B2

(12) United States Patent
Fromme

(10) Patent No.: US 6,859,959 B2
(45) Date of Patent: Mar. 1, 2005

(54) SPRING LATH FOR SITTING OR RECLINING FURNITURE

(75) Inventor: Heinrich Fromme, Schloss Holte-Stukenbrock (DE)

(73) Assignee: Froli Kuntstoffwerk Heinrich, Schloss Holte-Stukenbrock (DE)

( * ) Notice: Subject to any disclaimer, the term of this patent is extended or adjusted under 35 U.S.C. 154(b) by 0 days.

(21) Appl. No.: 10/427,983

(22) Filed: May 2, 2003

(65) Prior Publication Data

US 2004/0003467 A1 Jan. 8, 2004

(30) Foreign Application Priority Data

May 4, 2002 (DE) ..... 202 07 113 U

(51) Int. Cl.[7] ..... A47C 23/00
(52) U.S. Cl. ..... 5/264.1; 5/239; 267/100
(58) Field of Search ..... 5/264.1, 263, 245, 5/236.1, 239, 237; 267/100

(56) References Cited

U.S. PATENT DOCUMENTS 1,399,028 A * 12/1921 Smith ..... 5/407
2,773,271 A * 12/1956 Wetzler ..... 5/264.1
5,058,223 A * 10/1991 Vasquez ..... 5/237
5,426,799 A 6/1995 Ottiger et al.
5,588,165 A 12/1996 Fromme
5,639,071 A * 6/1997 Kitchen ..... 267/100
6,477,727 B1 * 11/2002 Fromme ..... 5/247

FOREIGN PATENT DOCUMENTS

DE 297 21 656 2/1999
DE 299 16 753 12/2000

* cited by examiner

*Primary Examiner*—Alexander Grosz
(74) *Attorney, Agent, or Firm*—Burns, Doane, Swecker & Mathis, L.L.P.

(57) ABSTRACT

A spring-support lath for supporting upholstery of furniture includes a lath body defining a longitudinal direction and having a pair of longitudinally extending U-profiles. Each U-profile is of U-shaped cross-section open in a downward direction and spaced apart in a lateral direction. The U-profiles are interconnected at their longitudinally spaced ends by end pieces and by fixed links situated intermediate the end pieces. The fixed links are spaced apart longitudinally, and at least some of the fixed links include a fastener structure such as a T-shaped member or an oblong hole for connecting to spring elements.

20 Claims, 6 Drawing Sheets

SPRING LATH FOR SITTING OR RECLINING FURNITURE

This application claims priority under 35 U.S.C. §§119 and/or 365 to Patent Application No. 202 07 113.8 filed in Germany on May 4, 2002, the entire content of which is hereby incorporated by reference.

BACKGROUND OF THE INVENTION

The present invention relates to a spring lath for the underlying upholstery on sitting or reclining furniture. The underlying upholstery surface is subdivided into partial surfaces by way of spring elements placed upon the latter and also comprises an upholstery layer, and the spring lath has at least one rail body that is open on the bottom side and features on both sides end pieces that are to be fastened to the sitting or reclining furniture, in particular to the lath grid of a bed.

Sitting or reclining furniture, in particular beds, feature upholstery surfaces that are comprised of upholstery layers (mattresses, etc.), which, in turn, are placed on an underlying upholstery. Lath grids are used normally as underlying upholstery pieces. If a physiological resting position of the body is to be achieved, by way of its underlying upholstery, the bedding system should allow for sufficient lowering in the shoulder and the pelvic areas of the user thus making it possible for the user's spine to be essentially stretched out in its supine as well as side positions. For this purpose, the lath work structures of sitting or reclining furniture, in particular the lath grids of beds that are to be viewed as lath work structures, feature laths realized in the form of spring laths between the lengthwise guide rails, which are arranged crosswise and receive the upholstery layer. On both ends, the lath heads feature end pieces allowing them to be fastened in place on the lath work structure and/or the lengthwise guide rails and that can—for the purpose of improving the resting comfort—also be subdivided and connected to one another by way of joints in order to be able to raise the head part or the foot part separately.

In order to improve the resting comfort further, EP 0401712 (corresponding to Ottiger et al. U.S. Pat. No. 5,426,799) and EP 0653174 (corresponding to Fromme U.S. Pat. No. 5,588,165) propose that the sitting or reclining surface be subdivided not only via spring laths in the lengthwise direction but also via spring elements in the crosswise direction, thus resulting in a resting surface that is subdivided into multiple surfaces. Due to the special spring design, upholstery systems of this kind allow for the use of (relatively) thin and, therefore, also light upholstery layers without compromising comfort. EP-0 401 712 correspondingly provides for the use of inflexible laths realized as U-profiles with upright standing flanges that receive the spring elements and restrict their lift action.

As shown in FIG. 6, German (UM) No. 297 21 656.2 introduced a spring lath 15 to the art intended to form an upholstery surface in such a way that a number of said spring laths 15 are arranged running parallel relative to one another in the lath work structure of a piece of sitting or reclining furniture, in particular distributed across the length between the two lengthwise guide rails 13, 14 of a lath grid of a bed. A number of spring elements 20 are arranged in splits and rows on these spring elements, forming an essentially even pattern for supporting a mattress 10. This spring lath is comprised of a plastic rail with an essentially U-shaped cross section defined by two legs 16. The lath heads 15.1 are realized as end pieces that allow for fastening the lath on the lath work structure of the sitting or reclining furniture and/or the lengthwise guide rails 13, 14 of a lath grid for beds.

In the present context, it is disadvantageous, however, that the manufacturing of spring laths of this type is expensive and the assembly of these kinds of lath grids extremely labor-intensive, thereby precluding the feasibility of easy, economical manufacturing.

Therefore, the underling object of the present invention consists in the further development of spring laths that are known in the art with the goal of simplifying their manufacture and assembly in order to make them less expensive.

SUMMARY OF INVENTION

The spring lath according to the invention has a body formed by two U-profiles arranged at a distance in relation to each other and open on their bottom side. Along their lengthwise extension, the U-profiles are connected by way of fixed links, that are arranged at a distance relative to one another, and at their lath heads they are connected by way of end pieces realized in such a way that they are can be easily fastened to the lath work structure and/or to the lengthwise guide rails. These spring rails, in turn, arranged at a distance relative to one another, form the basis of an upholstery surface upon which spring elements are placed, and an upholstery layer that is supported by the spring elements supplements the upholstery surface.

In this context, the contact or head plates of such spring elements predetermine the geometry of the arrangement of the fastening means and, therefore, also of the spring laths. Correspondingly, it is possible to arrange the spring laths at the desired distances and parallel relative to one another in such a way that the spring elements essentially form an even pattern receiving the upholstery layer as a layer of upholstery material to be placed (on top of the structure).

In order to strengthen the spring laths, it is advantageous if the height of the U-profile is larger at its middle point vis-a-vis the two lath ends that are fastened to the lengthwise guard rails. This excess height in the mid-section is between ⅓ to ⅔ of the height of the U-profile in the edge. Moreover, a flange is envisioned on the free ends of the legs of the U protruding toward the outside by approximately once the thickness of the material of the leg.

The U-profiles are advantageously connected to each other in pairs by way of fixed links that are arranged crosswise in relation to the lengthwise extension of the spring lath. The fixed links comprise fastening means for the spring elements. Advantageously, the fixed links, in conjunction with a link plate and with cross walls, form a U-form that is aligned crosswise relative to the lengthwise extension of the lath body of the spring lath. The spring elements are placed onto these fastening means. In order to be able to maintain a low construction height, one advantageous further realization envisions that the link plates of the fixed links are to be realized as bowl-like impressions. Thus, it is possible to accommodate the base of the spring elements lowered into the bowl-like impression.

One embodied example envisions a hole as a fastening means for the spring elements that engages a peg, realized in one piece with each of the bases of the spring elements, thereby fastening the spring element in place on the spring lath Another embodied example envisions (in a way known in the art from German (UM) No. 299 16 753.4) a T-shaped one-piece-attachment as a fastening means that acts in conjunction with the opening realized in a shape similar to an oblong hole, thereby making it possible to fasten the spring element in place on the spring lath. In this context, either the link plate or the base of the spring element could be equipped with a T-shaped one-piece-attachment, and the other of the spring element and the link plate would feature an opening in a shape similar to an oblong hole to receive the T-shaped hole. To simplify assembly, the T-shaped one-piece-attachment can be realized as a rotatable cap placed upon the link plate.

To fasten the spring lath in place on the lath work structure of the sitting or reclining furniture and/or the lath grid, the end pieces connecting the two U-profile are advantageously realized in the shape of plates, and they rest against the lath work structure and/or the lengthwise guide rails of the lath grid frame. Correspondingly, the end plates are easily fastened without the need for a pilot hole intended for dowels. Most suitably, fastening is achieved with pins, screws, if necessary, by way of shooting them into place; this, however, does not preclude a fastening process with the assistance of dowels.

Advantageously, the end pieces are realized in such a way that they feature a flange, either mounted or attached in one piece, which is able to support the spring lath on the lath work structure of the sitting or reclining furniture and/or the lengthwise guide rail of the lath grid. Thus, it is possible for the shearing forces acting upon the fastening means to be absorbed or—if the tab, either mounted or attached in one piece, engages in the lath work structure and/or the lengthwise guide rail—eliminated altogether and are directed into the lath work structure of the sitting or reclining furniture and/or into the frame of the lath grid.

At least with regard to the lath body comprised of U-profiles with the fixed links and end pieces, the spring laths are advantageously realized in one piece as an injection-molded plastic part in accordance with a method known in the art. This method permits economical manufacturing, in particular when manufacturing large volumes. The plastic that is used for this purpose is comprised of a thermoplastic material.

In an effort to improve the stability and the flexibility, advantageously, the plastic is supplied with a fiber reinforcement. An advantageous further development envisions, in particular, long-fiber plant material for this purpose. Adding filler materials to the plastic material such as color pigments allows for adjusting the visual surface of the lath work. The result is a colored spring lath the color of which can also be utilized to designate spring properties and flexibility capacities. Similarly, it is possible to add a natural filler material to the plastic material, preferably wood chips or saw dust. With this addition, it is possible to design spring laths that have a wood-like appearance.

BRIEF DESCRIPTION OF THE DRAWINGS

The invention will subsequently be illustrated in more detail using the examples depicted in FIGS. 1 to 5.

DESCRIPTION OF PREFERRED EMBODIMENTS OF THE INVENTION

Figure 5:
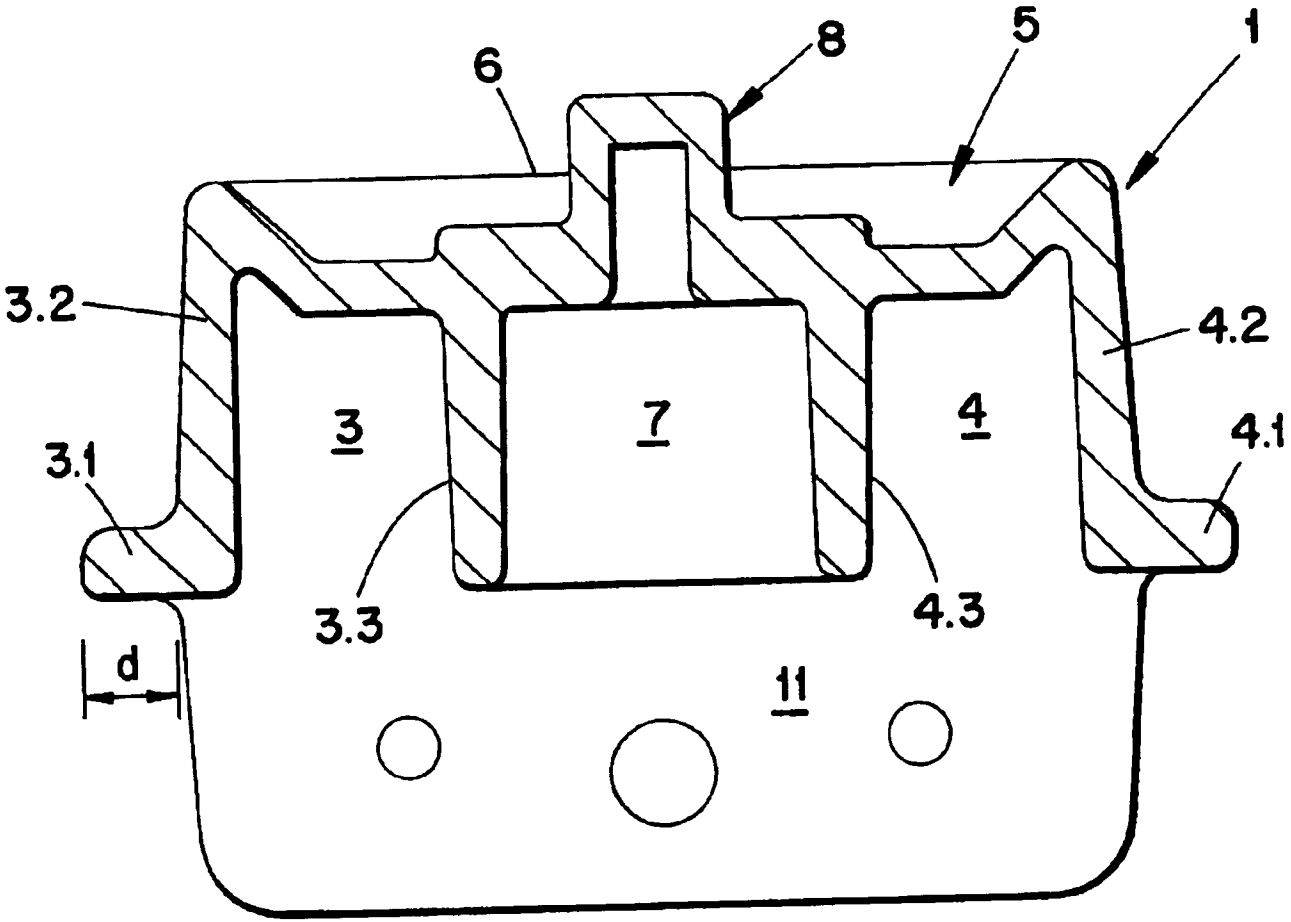
FIG. 5 is a cross section of a spring lath taken along line V—V in FIG. 1.

The figures show a spring lath which includes a lath body 1. Said body is formed by U-profiles 3 and 4 which run longitudinally parallel to each other, while being spaced apart laterally. Each U-profile is of U-shaped cross section formed by two legs 3.2, 3.3 and 4.2, 4.3 (see FIG. 5). The U-profiles 3, 4 are interconnected by fixed links 5 that are spaced apart along the longitudinal direction (see FIG. 3). The U-profiles are open on their bottom sides. To improve the stability, the lath body 1 is symmetrically deflected upward toward the middle. This causes the height H of the U-profile in the middle area to be 4/3 to 5/3 of the height h of the U-profile in the edge areas (see FIG. 3). Reinforcement flanges 3.1 and/or 4.1 are advantageously fashioned in one piece to the bottom outside edges of the two U-profiles and extend longitudinally. These reinforcement flanges are oriented in a direction approximately perpendicularly in relation to the legs of the U-profiles 3 and/or 4, and their depth d in that direction is at least equal to the material thickness of the legs 3.2, 4.2 of the U-profiles 3 and/or 4. The intermediate fixed links 5 are distributed along the length of the U-profiles at regular distances from each other.

Figure 1:
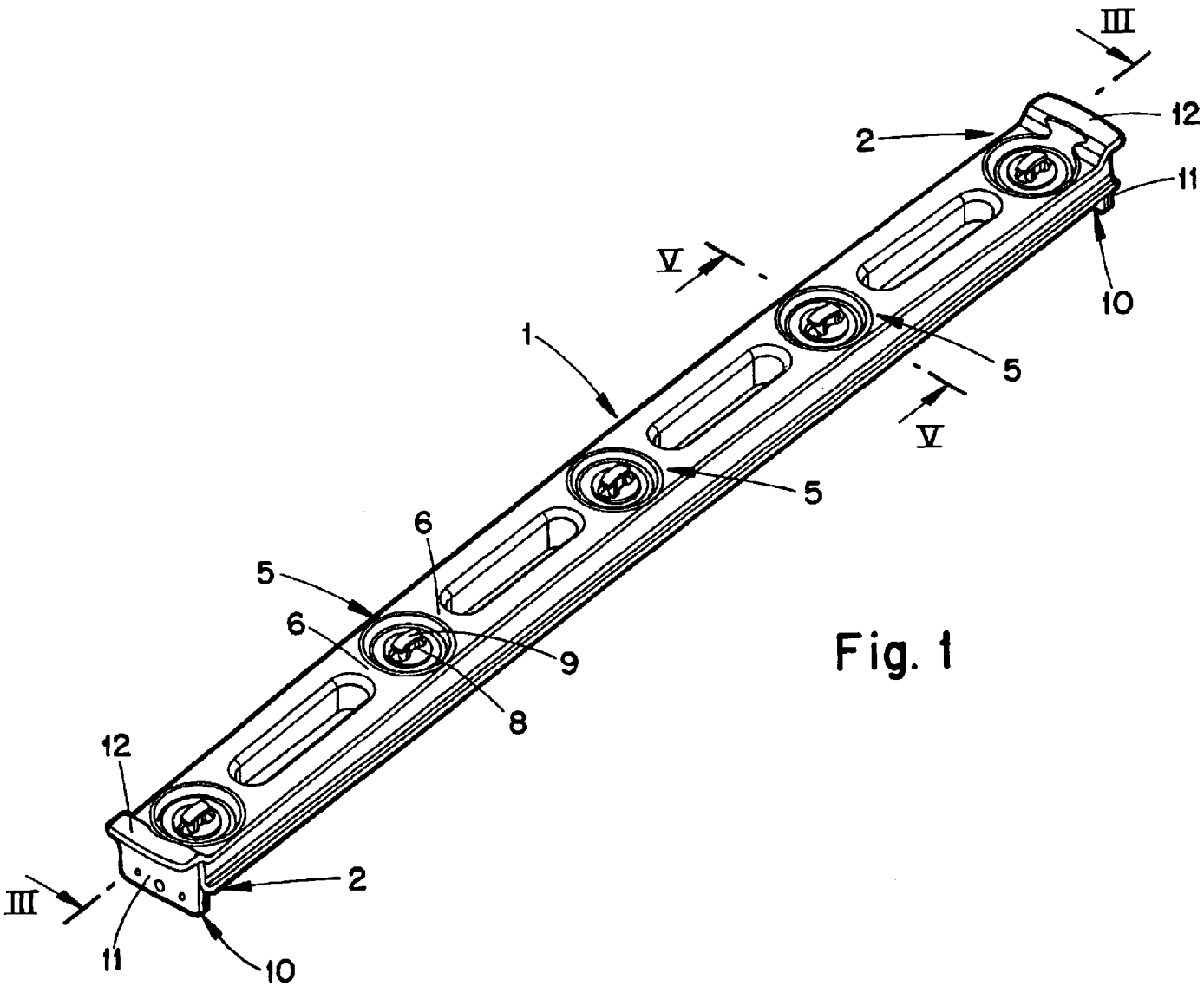
FIG. 1 is a top view of a spring lath (perspective view, schematic).
Figure 2:
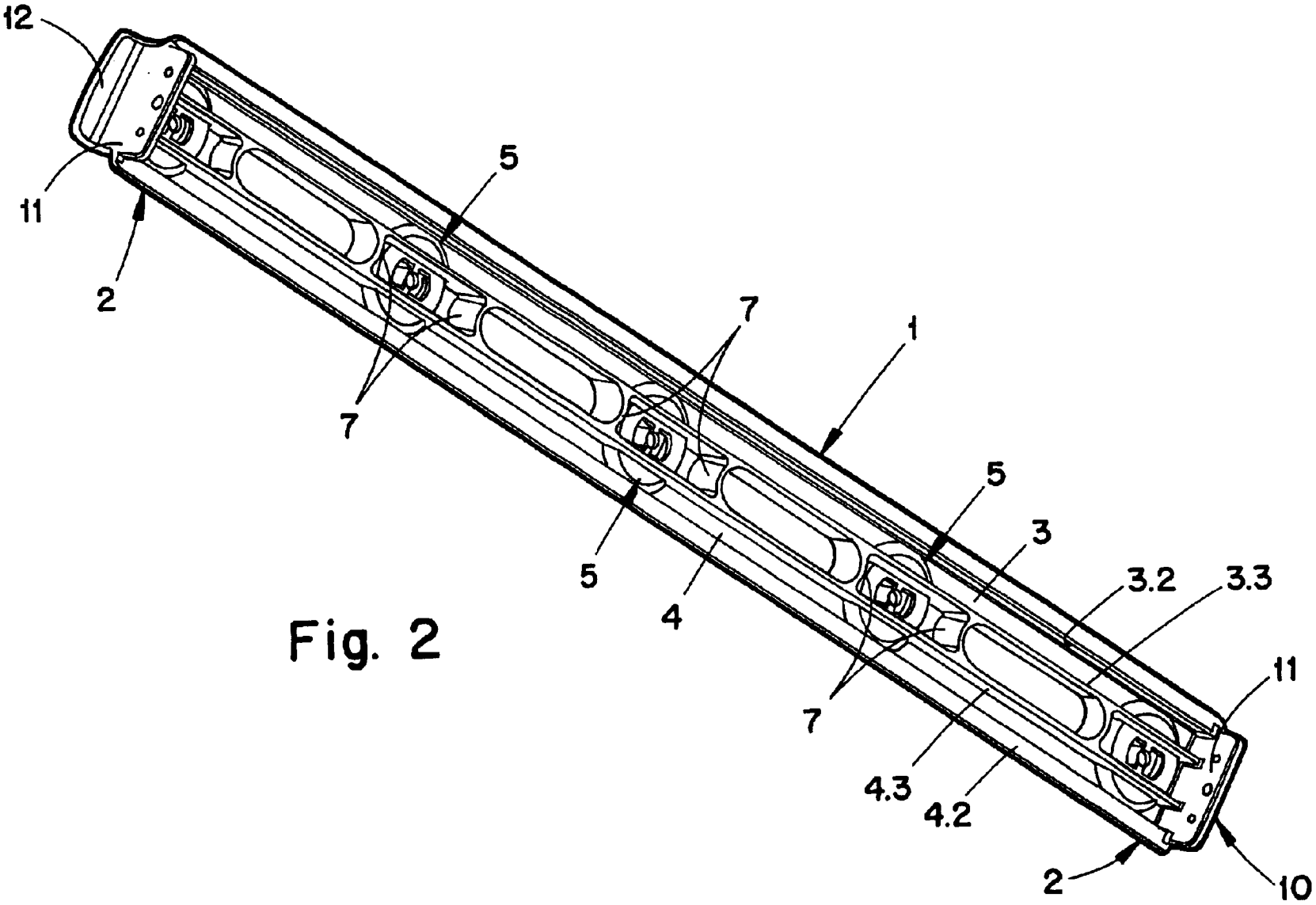
FIG. 2 depicts a bottom view of a spring lath (perspective view, schematic).
Figure 3:
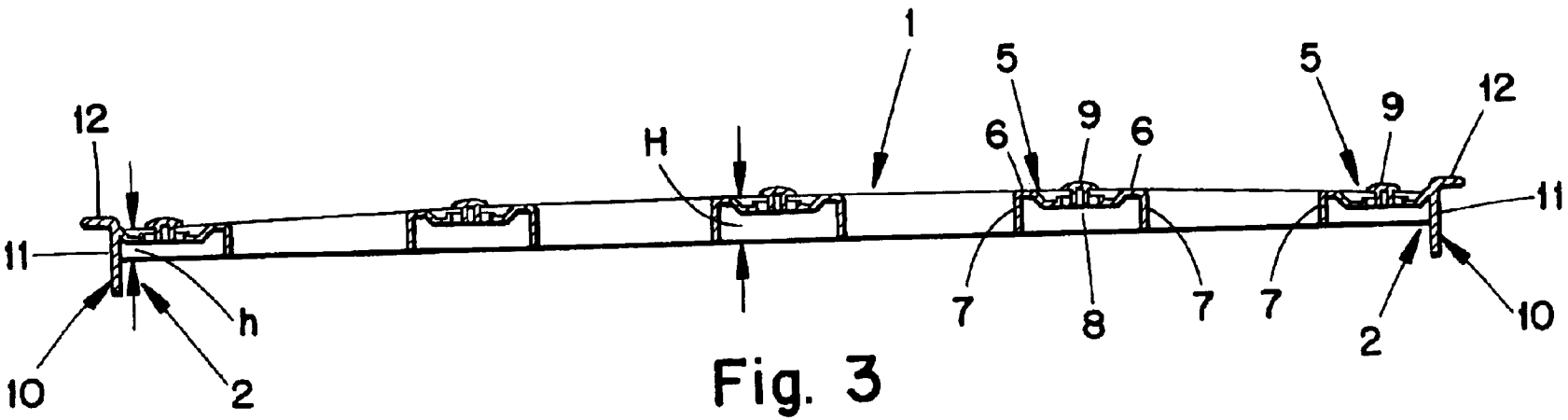
FIG. 3 depicts a longitudinal section of a spring lath (section III—III, FIG. 1).

These intermediate fixed links 5 include a plate portion comprised of two link plates 6 extending between the U-profiles 3 and 4, and downwardly extending cross walls 7, which, together with the link plates 6, form a crosswise arranged U-form (see FIG. 3).

Figure 4:
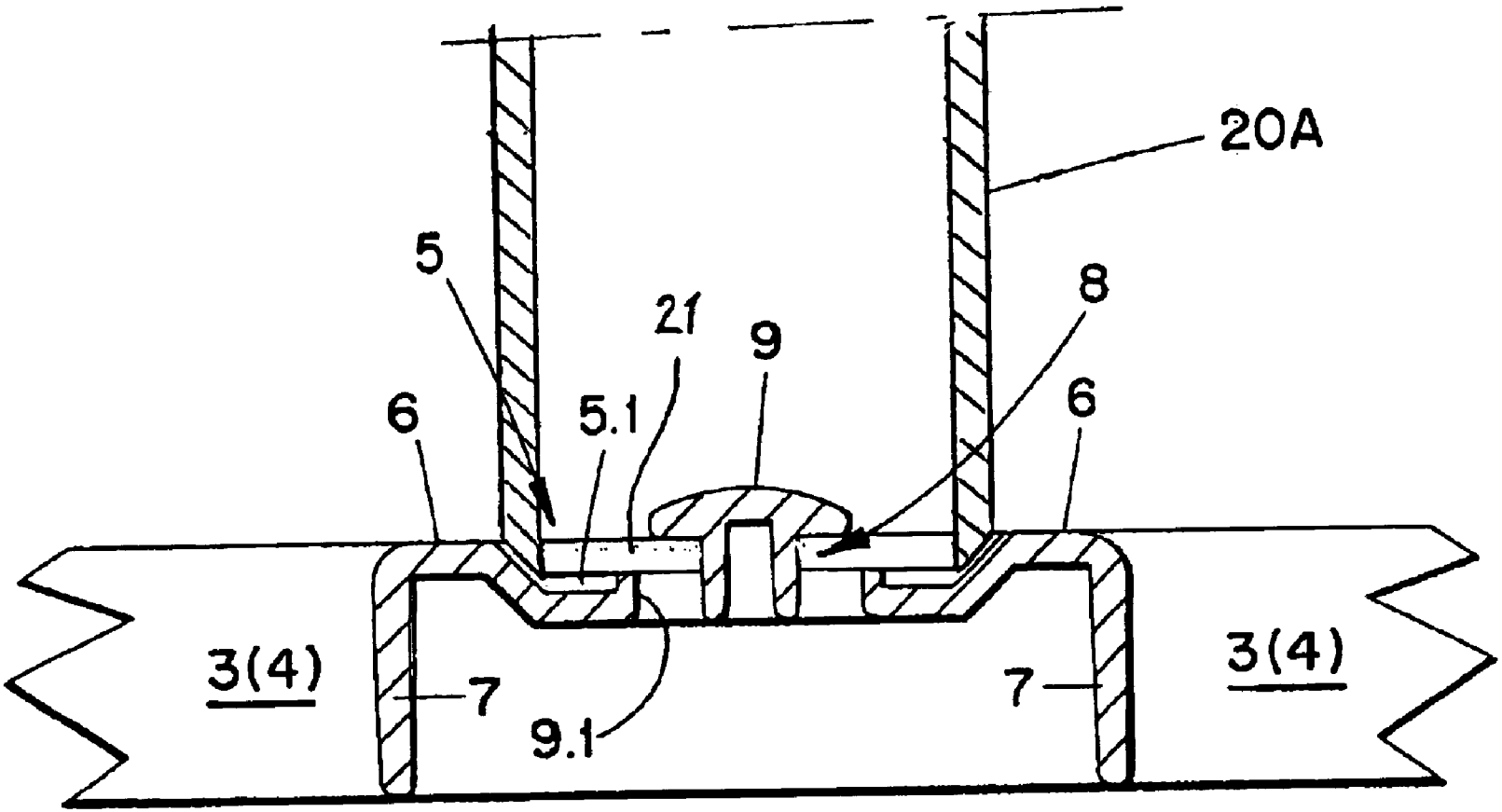
FIG. 4 shows a detail longitudinal section.

The link plates 6 of each of the fixed links 5 extending between the U-profiles 3 and 4 comprise an attachment 8 as a fastening means for spring elements, the attachment including a terminal plate 9 that is designed in approximately T-shaped form. This T-shaped terminal plate 9 of the attachment 8 can pass through a slot 21 formed in a base of a spring element 20A (FIG. 4). To anchor the spring element 20A, the plate 9 is rotated by 90° about a vertical axis after being inserted through the slot 21 so that the slot becomes oriented perpendicular to the long dimension of the plate and thus prevents removal of the plate. It is advantageous to envision a ramp in the area of the attachment 8 that rises in the direction of the rotation but breaks off when the 90° position is reached. This way, the fastened spring element would be latched. Advantageously, these fixed links 5 are provided with upwardly-open bowl-like impressions 5.1 in order to receive the base of the respective spring element and the associated fastening means.

Figure 6A:
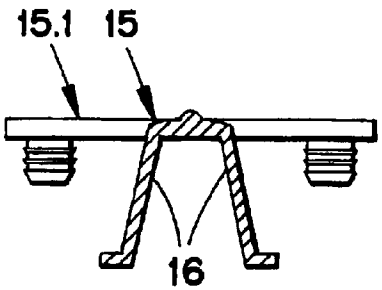
Fig. 6a (PRIOR ART)
FIG. 6*a* is a cross section taken along line VI—VI in FIG. 6.
Figure 6:
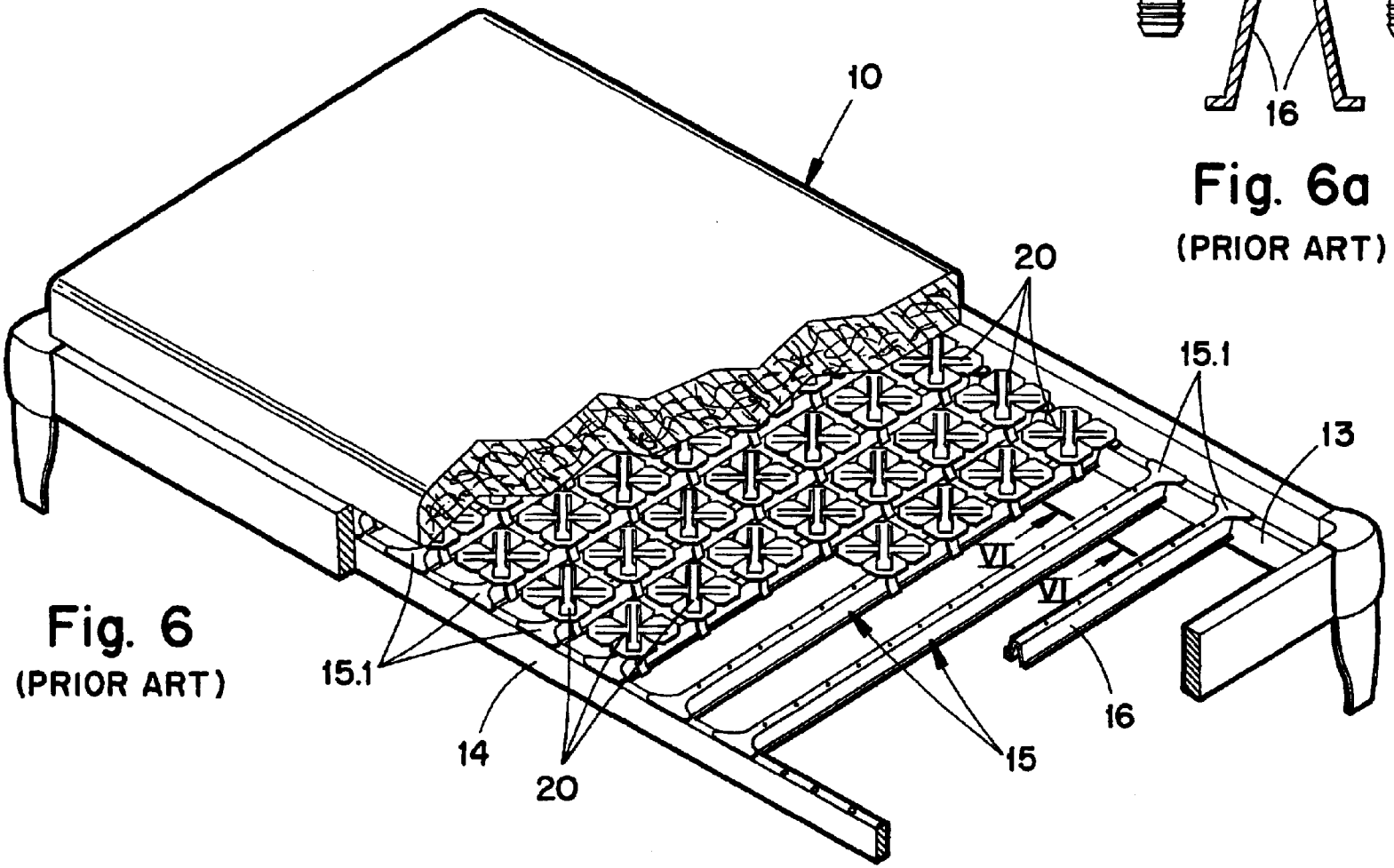
Fig. 6 (PRIOR ART)
FIG. 6 is a top perspective view, partially broken away of a prior art mattress support.

Alternatively, the plate 9 could be omitted, wherein the spring would carry a T-shaped projection capable of being inserted through a slot 9.1 of the fixed link 5. connections formed by the fixed links 5. These end pieces 10 are equipped with an end plate 11 (FIG. 5) that rests planely against the lath work structure and/or the lengthwise guide rails of a lath grid frame (both not shown but similar to the prior art of FIG. 6) and can be fastened in place using pins, screws or also dowels. The end pieces 10 are advantageously attached using pins or screws. Moreover, for purposes of support, it is possible to fashion a tab 12 in one piece with each end plate 11, and the end plates 11 and the tabs 12 are configured in such a way that the tabs 12 are supported inside the lath work structure of the seating or reclining furniture and/or the lengthwise guide rails of the frame of the lath grid of a bed. For this purpose, the tabs 12 extend approximately perpendicularly from the end plates 11. During assembly, these tabs 12 ensure that the lath bodies 1 are placed at a uniform distance vis-a-vis the upper edge of the lath work structure and/or the lengthwise guide rails.

Although the present invention has been described in connection with preferred embodiments thereof, it will be appreciated by those skilled in the art that additions, deletions, modification, and substitutions not specifically described may be made without departing from the spirit and scope of the invention as defined in the appended claims.

What is claimed is:

1. A spring-support lath for supporting upholstery of furniture, and comprising a lath body defining a longitudinal direction and comprising a pair of longitudinally extending portions each of U-shaped cross-section open in a downward direction and spaced apart in a lateral direction; the U-shaped portions being interconnected at their longitudinally spaced ends by end pieces and by fixed links situated intermediate the end pieces, the fixed links being spaced apart longitudinally; at least some of the fixed links including fastening means for connecting to spring elements, wherein each of the fixed links includes a plate portion and cross walls projecting downwardly from the plate portion.

2. The spring-support lath according to claim 1 wherein a height of the lath at its longitudinal ends is less than a height thereof at a point midway between the longitudinal ends.

3. The spring-support lath according to claim 2 wherein the height of the lath at the midway point is greater than the height thereof at the ends by an amount of at least ⅓ of the height at the ends, the amount being no greater than ⅔ of the height at the ends.

4. The spring-support lath according to claim 1 wherein each U-shaped portion includes a lateral flange extending longitudinally and projecting from a respective U-shaped portion in a direction laterally of the longitudinal direction by a distance equal to at least a thickness of each leg.

5. The spring-support lath according to claim 1 wherein the fastening means comprises a vertical through-hole.

6. The spring-support lath according to claim 1 wherein the fastening means comprises a T-shaped attachment member.

7. The spring-support lath according to claim 6 wherein the T-shaped attachment member is rotatable relative to the respective fixed link about a vertical axis.

8. The spring-support lath according to claim 7 wherein the U-shaped portions and the end pieces are injection molded together as a one-piece element.

9. The spring-support lath according to claim 8 wherein a material of which the one-piece element is injection-molded, comprises reinforced plastic.

10. The spring-support lath according to claim 9 wherein a reinforcement component of the reinforced plastic comprises plant fibers.

11. The spring-support lath according to claim 9 wherein a material of which the one-piece element is injection-molded comprises plastic with natural filler material.

12. The spring-support lath according to claim 11 wherein the filler material comprises one of wood chips and saw dust.

13. The spring-support lath according to claim 1 wherein each end piece includes a flange extending therefrom in a lengthwise direction of the lath for supporting the lath.

14. A spring-support lath for supporting upholstery of furniture, and comprising a lath body defining a longitudinal direction and comprising a pair of longitudinally extending portions each of U-shaped cross-section open in a downward direction and spaced apart in a lateral direction; the U-shaped portions being interconnected at their longitudinally spaced ends by end pieces and by fixed links situated intermediate the end pieces, the fixed link being spaced apart longitudinally; at least some of the fixed links including fastening means for connecting to spring elements, wherein each of the fixed link includes a plate portion forming an upwardly open impression for receiving a spring bottom.

15. The spring-support lath according to claim 14 wherein each of the fixed links includes a plate portion and cross walls projecting downwardly from the plate portion.

16. The spring-support lath according to claim 15 wherein the cross walls are parallel to one another and spaced apart along a length of the lath.

17. The spring-support lath according to claim 15 wherein the plate portion includes an upwardly open impression and a pair of link plates spaced apart along the lath length, the link plates being situated on opposite sides of the impression for receiving a spring bottom.

18. An upholstery-support arrangement lath for furniture comprising a lath body defining a longitudinal direction, the lath body including a pair of longitudinally extending portions each of U-shaped crass section open in a downward direction and spaced apart in a lateral direction, the U-shaped portions being interconnected at their longitudinally spaced ends by end pieces and by fixed links situated intermediate the end pieces, the fixed links being spaced apart longitudinally; and springs fastened to at least some of the fixed links and extending upwardly therefrom, wherein a bottom of each spring is seated in an upwardly open impression in a respective fixed link.

19. The spring-support lath according to claim 18 wherein each of the fixed link includes a plate portion forming an upwardly open impression for receiving a spring bottom.

20. The lath according to claim 18 wherein one of the spring bottom and the impression includes an oblong slot and the other of the spring bottom and the impression includes a T-shaped projection secured in the slot.

* * * * *

UNITED STATES PATENT AND TRADEMARK OFFICE

CERTIFICATE OF CORRECTION

PATENT NO. : 6,859,959 B2
APPLICATION NO. : 10/427983
DATED : March 1, 2005
INVENTOR(S) : Heinrich Fromme It is certified that error appears in the above-identified patent and that said Letters Patent is hereby corrected as shown below:

Title Page, item (73) should read -- Froli Kunststoffwerk Heinrich Fromme OHG, Schloss Holte-Stukenbrock (DE)

Signed and Sealed this

Twenty-fifth Day of July, 2006

JON W. DUDAS
*Director of the United States Patent and Trademark Office*